US007579567B2

(12) United States Patent
Lee et al.

(10) Patent No.: US 7,579,567 B2
(45) Date of Patent: Aug. 25, 2009

(54) WORKLIGHT WITH ERGONOMIC SWITCH

(75) Inventors: Wade Lee, Danville, CA (US); Donald R. Sandell, San Jose, CA (US)

(73) Assignee: EML Technologies LLC, Danville, CA (US)

( * ) Notice: Subject to any disclaimer, the term of this patent is extended or adjusted under 35 U.S.C. 154(b) by 0 days.

(21) Appl. No.: 11/396,318

(22) Filed: Apr. 1, 2006

(65) Prior Publication Data

US 2007/0227871 A1 Oct. 4, 2007

(51) Int. Cl.
*H01H 3/12* (2006.01)

(52) U.S. Cl. ..... 200/341; 200/345

(58) Field of Classification Search ..... 200/310–314, 200/341–345, 60
See application file for complete search history.

(56) References Cited

U.S. PATENT DOCUMENTS

| | | | | | |
|---|---|---|---|---|---|
| 3,367,206 | A | | 2/1968 | Moody | |
| 4,251,703 | A | * | 2/1981 | Hoeft et al. | 200/341 |
| 4,527,030 | A | * | 7/1985 | Oelsch | 200/515 |
| 4,970,631 | A | * | 11/1990 | Marshall | 362/105 |
| 5,140,216 | A | * | 8/1992 | Darr | 313/25 |
| 5,201,824 | A | * | 4/1993 | Kato et al. | 200/520 |
| 5,203,448 | A | | 4/1993 | Osada et al. | |
| 5,219,446 | A | * | 6/1993 | Klepac | 362/154 |
| 5,256,843 | A | * | 10/1993 | Chiba et al. | 200/517 |
| 5,463,538 | A | * | 10/1995 | Womack | 362/106 |
| 5,493,482 | A | * | 2/1996 | Bowen | 362/260 |
| 5,617,946 | A | * | 4/1997 | Acampora et al. | 200/407 |
| 5,722,533 | A | * | 3/1998 | Gallone | 200/302.2 |
| 5,746,495 | A | * | 5/1998 | Klamm | 362/577 |
| 6,042,043 | A | * | 3/2000 | Wislinski | 242/473.9 |
| 6,088,531 | A | | 7/2000 | Endoh | |
| 6,575,587 | B2 | * | 6/2003 | Cramer et al. | 362/105 |
| 6,585,400 | B2 | * | 7/2003 | Leen | 362/418 |
| 6,604,837 | B2 | * | 8/2003 | Sandberg | 362/191 |
| 6,604,847 | B2 | * | 8/2003 | Lehrer | 362/572 |
| 6,900,404 | B2 | | 5/2005 | Searle et al. | |
| 6,961,519 | B2 | * | 11/2005 | Wright | 396/264 |
| 6,965,085 | B1 | | 11/2005 | Mario et al. | |
| 6,979,100 | B2 | * | 12/2005 | Reiff et al. | 362/184 |
| 7,063,444 | B2 | * | 6/2006 | Lee et al. | 362/285 |
| 7,090,381 | B2 | * | 8/2006 | Kovacik et al. | 362/374 |
| 7,125,140 | B2 | * | 10/2006 | Koch et al. | 362/205 |

(Continued)

*Primary Examiner*—Michael A Friedhofer
*Assistant Examiner*—Lisa N Klaus
(74) *Attorney, Agent, or Firm*—Elliot B. Aronson

(57) ABSTRACT

An ergonomically designed switch for a halogen worklight. The worklight includes a switch housing attached to the worklight head and a push-action switch mounted in the switch housing for energizing one or more halogen lamps mounted in the worklight head. An ergonomic switch is operated by pressing on a switch button, which is formed to present an ergonomically sized engagement surface to the user. The size of the engagement surface is related to the typical size of a finger pad of the human hand. Through the simple expedient of providing a substantial switch button on the actuating shaft of the switch and sizing the engagement surface of the button to correlate with the size of the human hand, the ease and comfort of operation of the worklight is dramatically improved over worklights having awkward switch mechanisms long thought in the prior art to be unavoidable. The switch button is structured and arranged with a guide assembly to provide stabile travel and a solid feel to the user when activating the switch.

11 Claims, 2 Drawing Sheets

U.S. PATENT DOCUMENTS 7,159,993 B1 * 1/2007 Lu ..... 362/116
7,180,024 B2 * 2/2007 Sugita ..... 200/341
7,192,160 B2 * 3/2007 Reiff et al. ..... 362/231
7,201,491 B2 * 4/2007 Bayat et al. ..... 362/171
7,306,349 B2 * 12/2007 Waters ..... 362/219
7,370,989 B2 * 5/2008 Bayat et al. ..... 362/186
2005/0117340 A1 * 6/2005 Lee et al. ..... 362/252

* cited by examiner

WORKLIGHT WITH ERGONOMIC SWITCH

BACKGROUND OF THE INVENTION

The present invention relates to worklights and is more particularly directed to switch arrangements for turning the worklight on and off.

Worklights have become popular for use in such varied settings as construction jobs, industrial plants, automotive and auto body repair shops, artist and photographic studios, and projects around the home. A typical worklight has one or two, or sometimes more, worklight heads that are supported on a base, which may be set on the floor or other work surface, mounted on a tripod, hung from a hook or mounted on a clamp that is in turn clamped to a supporting structure in the work area. Halogen worklights have become popular because they provide a lot of light, but they also generate a lot of heat, too. The lights are typically turned on by a push-button switch that is mounted on the back of the worklight head. Some worklight heads are capable of several light levels. For example, the head may include two halogen lamps and the user actuates the light by consecutively pushing on a push-button switch to energize, in sequence, a single lamp, both lamps and neither lamp.

FIG. 1 shows a rear view of a halogen worklight of the prior art with a conventional switch arrangement. The worklight includes a worklight head 10 mounted on a base 11 that rests on the ground or other work surface during use. The illustrated head may be tilted with respect to the base to aim it in a desired direction by grasping handle 12 and pressing tilt-release lever 13 to adjust the angle of the head. The head includes a worklight body 14, the exterior of which is seen in FIG. 1, which houses one or more halogen lamps. Electrical connections are made to the lamps through switch box 16. Power is provided to the switch box through power cord 17. During operation the halogen lamps generate quite a bit of heat, and cooling fins 18 and 19 are provided on the worklight body to help dissipate the heat. Nevertheless, halogen worklights are known to get very hot during use.

The switch box is generally located at the rear of the worklight head, typically attached at the lower portion of the head as illustrated in FIG. 1. The halogen lamps are controlled by a push-button switch assembly 20 mounted on the switch box. The switch has a plunger in the form of a shaft that extends out of the box and is covered by a flexible plastic protective covering 21 or boot, as it is commonly called, to guard against dust and moisture from impairing the switch action or electrical connections. The plastic boot is held in place by screw ferrule 22, which screws onto the switch body. The switch is actuated by pushing on the top of the boot.

Although conventional, the use of such a switch arrangement is inconvenient at best and, more precisely, just plain awkward. The switch is not located in a very accessible position, and the switch mechanism can be fairly stiff. Users typically actuate the switch in one of several ways. In one approach the user grasps the switch and switch box between the thumb and one or two fingers, with the thumb on the top of the boot and the one or two fingers on the back of the switch box, and squeezes until the switch clicks. To achieve this, the user either leans over the worklight or stands to the side of or behind the worklight to gain sufficient access to locate the switch and orient the thumb and fingers properly, while guarding against contact with the hot surface of the worklight body. In another approach the user stands, kneels or bends so that the switch is visible and then simply pushes on the top of the boot with one finger—typically the index finger. This tends to hyperextend the distal interphalangeal joint causing discomfort at the least and for some users contributing to other future joint injury or repetitive stress injury. In any case the user sometimes has to stabilize the worklight by grasping the handle or base with the otherwise free hand so that the light does not slide when the switch is pushed.

Mounted on the back side of the housing, the switch box is typically out of the direct view of the user working in front of the light. The particularly bright light from a halogen worklight can also diminish, if not obscure altogether, the user's vision while reaching to shut off the light or change the light level. For a halogen lamp that has been operating for awhile, the exterior walls of the worklight head will become too hot for human touch, making it more difficult and potentially hazardous for an inattentive or less-than-careful user to reach around behind the light to turn it off. Moreover, finding and pushing the conventional push-button switch is made even more troublesome to the worker with a gloved hand. In addition to the problems of actuating the switch, the plastic boot 21 tends to deteriorate and crack with age, which effectively defeats the purpose of the boot. The plastic material tends to slide and rub against the end of the switch shaft every time the user pushes on the switch, leading to premature demise of the boot, which effectively limits the useful life of the worklight. The tendency of the plastic boot to slide or give under the user's finger when pressing the switch also makes for a mushy or spongy feel that is less than comfortable.

Notwithstanding the many inconveniences and deficiencies of the conventional worklight switch arrangement, the switch arrangement has nevertheless become the generally accepted standard. Over the years users have grown accustomed to these inconveniences and deficiencies, learned to tolerate them, and have come to accept them as inevitable and unavoidable.

SUMMARY OF THE INVENTION

The present inventors have refused to accept the inconveniences and deficiencies of the prior art as unavoidable. The present invention introduces a switch arrangement for a halogen worklight that is ergonomically designed for ease of use under realistic working conditions. As is customary, the worklight includes a switch housing attached to the worklight head and a push-action switch mounted in the switch housing for energizing one or more halogen lamps mounted in the worklight head. Briefly, an ergonomic switch according to the invention is operated by pressing on a switch button, which is formed to present an ergonomically sized engagement surface to the user. The size of the engagement surface is related to the typical size of a finger pad of the human hand. Through the simple expedient of providing a substantial switch button on the actuating shaft of the switch and sizing the engagement surface of the button to relate to the size of the human hand, the ease and comfort of operation of the worklight is dramatically improved over worklights having awkward switch mechanisms long thought in the prior art to be unavoidable. The switch button is structured and arranged with a guide assembly to provide stabile travel and a solid feel to the user when activating the switch.

Other aspects, advantages, and novel features of the invention are described below or will be readily apparent to those skilled in the art from the following specifications and drawings of illustrative embodiments.

DETAILED DESCRIPTION OF ILLUSTRATIVE EMBODIMENTS

Figure 2:
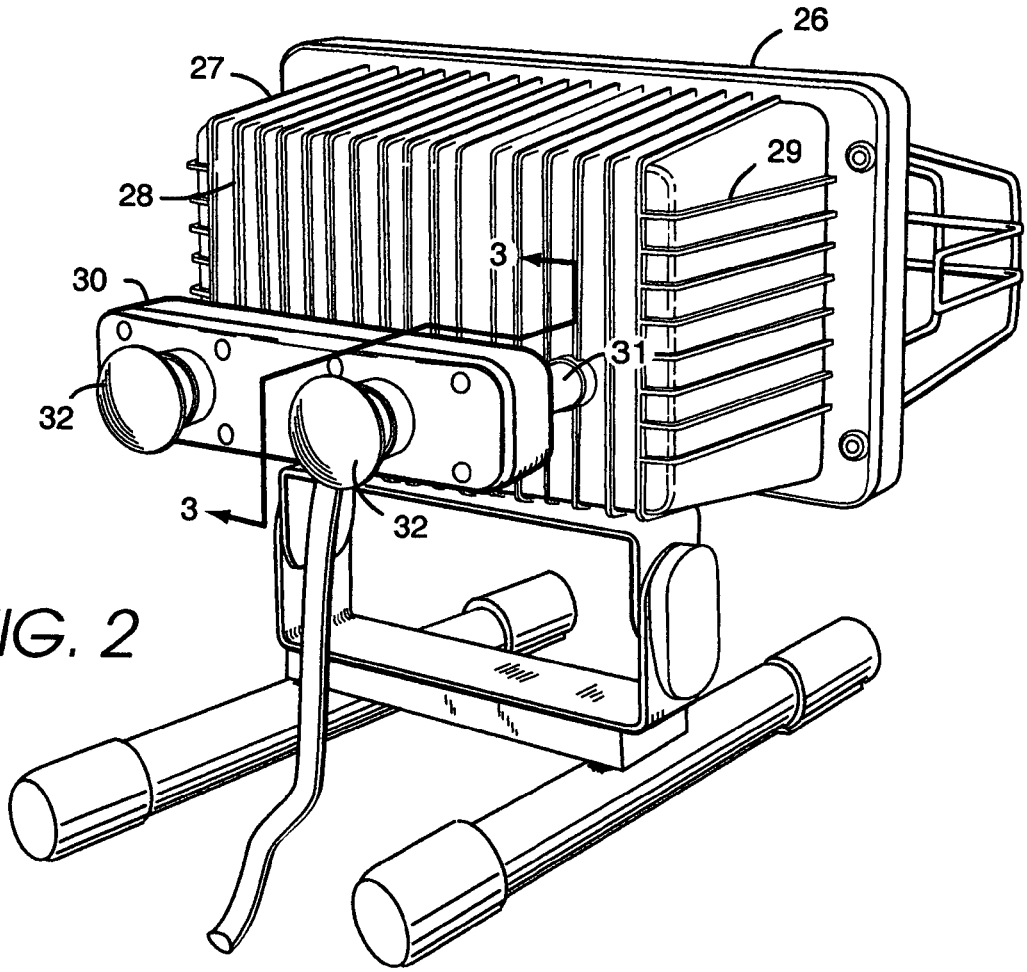
FIG. 2 is a rear perspective view of a worklight with an embodiment of ergonomic switch according to the invention.

FIG. 2 shows an overall view of a worklight head 26, now incorporating an embodiment of an ergonomic switch according to the invention. The head has a body portion 27, the exterior of which is seen in FIG. 2 with cooling fins 28 and 29. The interior of body portion 27 defines a lamp chamber, opening at the front, in which one or more halogen lamps are mounted. The switch for controlling the lamp or lamps is mounted in a switch housing or switch box 30, as it is commonly called, which in the embodiment of FIG. 2 is spaced apart from and attached to the back side of the worklight body 27. In the embodiment of FIG. 2 switch box 30 can serve a dual role as a grip that may be grasped to adjust the tilt of the worklight head. Switch box 30 is mounted to the worklight body by a pair of standoffs 31 symmetrically disposed at opposite ends of the switch box/grip, only one of the standoffs 31 being visible in FIG. 2. At least one of the standoffs 31 is hollow to provide a conduit for electrical wires to run from the switch to the one or more halogen lamps in the lamp chamber of the worklight head.

The embodiment of FIG. 2 includes a pair of ergonomic switch buttons 32. Each button is operatively associated with a push-action switch in switch box 30 for actuating the switch. Two buttons are shown because in worklight heads that include two halogen lamps, it may be desirable to control the lighting levels of each of the lamps independently. Other worklight embodiments may, of course, include only a single such button, which may actuate a simple ON-OFF switch or a multilevel switch actuating two or more light levels as well as the OFF position.

A conspicuous feature of the push buttons 32, unlike worklight switches of the prior art, is the generous size of the surface area presented to the user. Each of the switch buttons 32 presents a significantly larger engagement surface to the user than the tip of the plastic boot 21 shown in FIG. 1. The size and shape of the engagement surface are such as to be at least comparable to, if not larger than, the finger pad on the typical user's index finger. This makes it easier and more comfortable for the user to actuate the button. The greater engagement surface is beneficial for two reasons. For one, it makes it easier for the user to find the switch, particularly when the user is standing in front of the worklight and reaching behind it to shut the light off or turn it on. With a larger engagement surface the user's fingers find their way to the surface much more quickly and easily. Second, the switch is simply easier to push when the engagement surface of the button is large enough to receive substantially the whole contact pad on one of the user's fingers.

Thus to achieve the greater operability of the switch and the benefits of the invention, the switch button should have a minimal surface engagement area comparable with the minimal effective area of an exemplary user's finger pads. This is the case if the switch has minimum characteristic dimensions in the two perpendicular directions across the engagement surface of about five-eighths (0.625) inch. In the illustrated embodiment the engagement surface is circular, and the characteristic dimensions are equal and are simply the diameter of the circle. For rectangular buttons the characteristic dimensions may be taken to be the length and width. For other shapes of engagement surfaces the characteristic dimensions can be taken to be the effective length and width that a finger pad can effectively engage. Dimensions are referred to here as approximate, for example, about five-eighths inch, to allow for such practical factors as variations due to manufacturing tolerances or measurement uncertainties.

The minimum characteristic dimensions given above are approximately the typical effective size of the finger pad on the index finger. It is with this size of engagement surface that the button begins to achieve an ergonomic benefit in its performance. At this size the button relates to the dimensions of an adult human hand. With a slightly larger engagement surface, having characteristic dimensions of around seven-eighths (0.875) inch, the button is better sized to fit an exemplary gloved hand as well as the finger pad dimensions of a large human hand. It has been found that button performance is even more greatly improved with an even larger-sized engagement surface, having characteristic dimensions of at least about one and one-half (1.5) inch. At this size the user is able to locate the button by feel with less hunting and thus more quickly. This larger size provides for sufficient tactile feedback to the user to provide noticeably greater comfort and ease in locating the button and actuating the switch.

Figure 3:
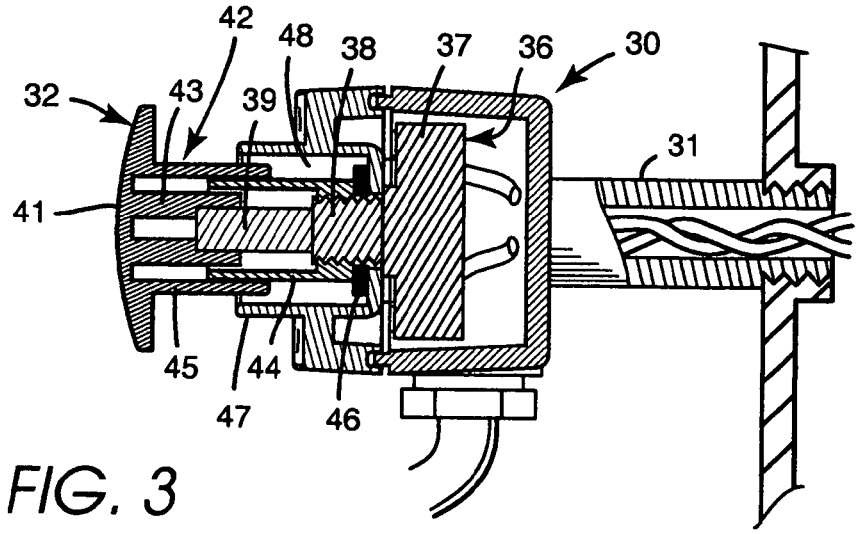
FIG. 3 is a cross-sectional view of the worklight switch of FIG. 2 along the line 3-3.

FIG. 3 shows a cross section of switch box 30 and one of the switch buttons 32. Mounted in switch box 30 is a push-action switch 36 with switch body 37, switch mounting threads 38, and a protruding depressible plunger shaft 39. In the embodiment of FIGS. 2 and 3 the switch button has a form commonly referred to as a mushroom cap. The button presents an engagement surface 41 for engagement by the user and a stem or base indicated generally at reference numeral 42. In FIGS. 2 and 3 the engagement surface of the mushroom cap is circular and slightly domed although other shapes may also be used. In the embodiment of FIG. 3 the stem of the cap has an inner shaft-receiving member 43 that is generally cylindrical with an interior bore that is sized and shaped to fit snugly over switch shaft 39 and is secured to the shaft by press-fitting, screw threads, adhesive, or any other convenient means.

Because of the wider engagement surface presented to the user, a greater torque may be applied to switch shaft 39 when the button is depressed if the user should engage the button closer to the edge of the engagement surface than the middle. A guide assembly is provided to stabilize the travel of the switch button and plunger shaft as the button is pushed and counteract the greater torque. This reduces play, reduces or eliminates the tendency to bind, and gives the button a more solid feel to the user. The guide assembly in the embodiment shown in FIG. 3 includes a pair of interengaging inner and outer guide members 44 and 45 that are disposed about the switch plunger shaft.

Inner guide member 44 in FIG. 3 has a generally cylindrical form with central bore that fits over switch shaft 39 and is fixed with respect to the switch housing. The switch shaft and switch mounting threads 38 extend through a hole in the switch housing cover. A washer 46 fits around the switch threads. The guide member 46 screws onto the switch threads 38 and is tightened down on washer 46 so as to secure the switch to the switch box cover in a watertight manner. Outer guide member 45 is also of generally cylindrical form coaxial with inner guide member 44 and fixed with respect to the switch button. The generally cylindrical outer guide member has a central bore receiving the inner guide member so that the outer surface of inner guide member 44 engages the inner surface of outer guide member 45, which defines a contact guide path for guiding the travel of the switch button and plunger as the switch button is depressed. As illustrated in FIG. 3 the guide members have co-axial cylindrical shapes that slide on one another. The guide members can be configured in other ways as well. For example, it is not necessary that the guide members continuously extend around the switch shaft. Two or more discrete pairs of interengaging guide members may also be used. For example, the guide members may form partial cylinders or other shapes. For a switch button presenting a square engagement surface the guide assembly could include, for example, four pairs of guide members positioned at the four corners of the square surface. Thus the guide members are not intended to be limited only to the interengaging co-axial cylinders illustrated here.

Where the engagement surface of the switch button has characteristic dimensions on the order of one and one-half (1.5) inch, it is desirable that the guide pathway along which the interengaging guide members move be spaced apart from the longitudinal axis of the plunger by at least about one-half (0.5) inch. This provides a particularly stabile travel for the button and a solid, reassuring feel to the user. In the embodiment of FIG. 3 the guide pathway is the axial direction along the surface of engagement between the inner and outer cylindrical guide members, which is co-axial with the longitudinal axis of switch plunger 39. The desired spacing is achieved when the inner cylindrical guide member has an outside diameter of at least about one-half (0.5) inch.

Figure 1:
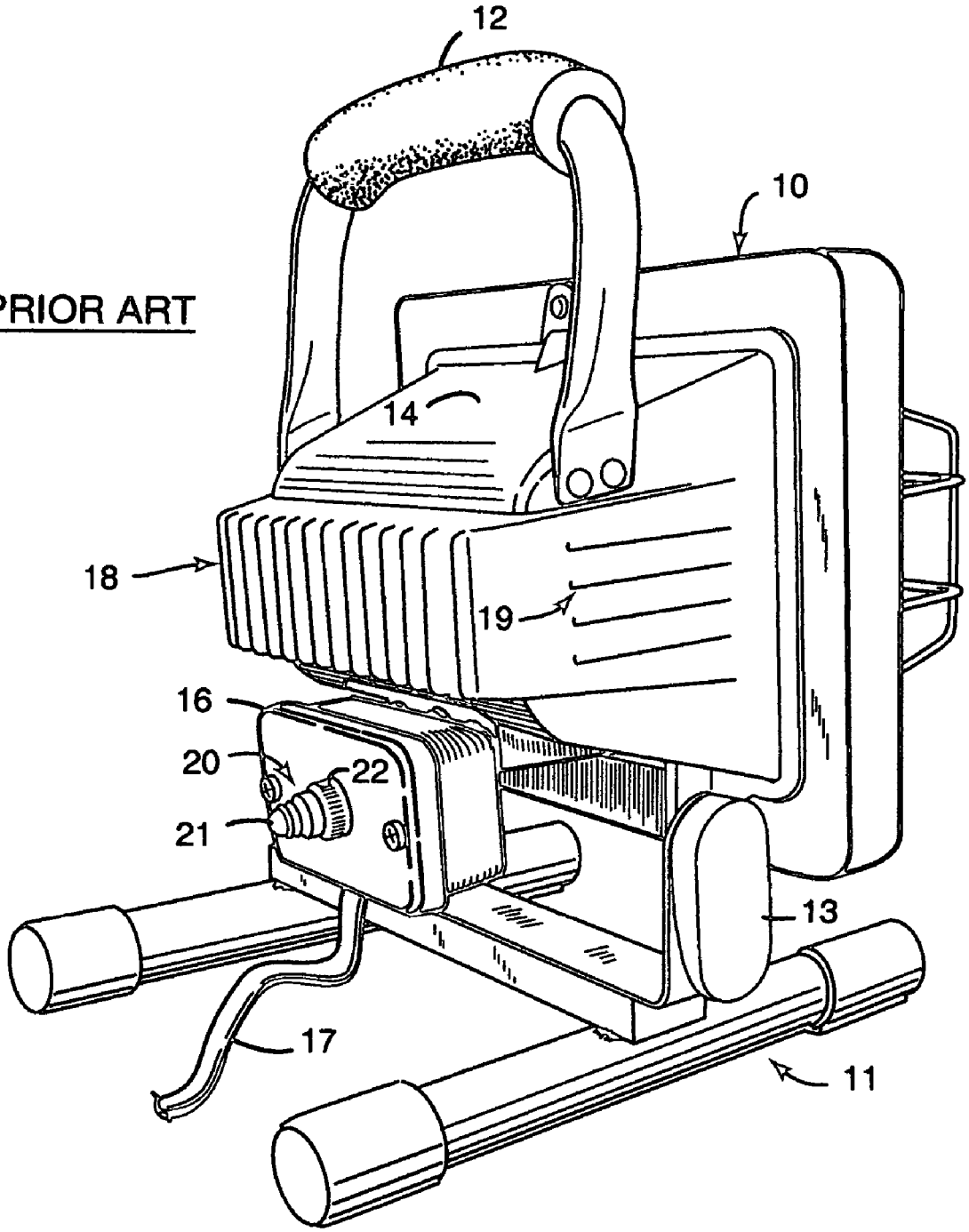
FIG. 1 is a rear perspective view of a worklight with a prior art switch.

Many worklights are designed for use in wet locations where they may be subject to accumulated moisture or are used outdoors, where they may be used under conditions of light precipitation. For such applications the switch mounting should not permit water to penetrate into the switch box or the switch itself. In the common prior art form of switch, the switch is protected against penetration of water by flexible plastic boot 21 covering the switch shaft as shown in FIG. 1. In the embodiment of FIG. 3 the switch shaft 39 is enclosed within the interengaging inner and outer guide members 44 and 45, which taken together form an inner wall of a water trap. Washer 46 compressed by inner guide member 44 seals the switch threads off from the switch housing. The cover of the switch housing is formed with an outer cylindrical wall 47 that surrounds the guide members 44 and 45, which taken together define an annular cavity indicated generally at reference numeral 48 serving as a water trap. Any precipitation or other form of moisture accumulating on the outer wall of guide member 45 may flow into water trap 48 and goes no further. Water accumulating in cavity 48 tends to accumulate along the bottom wall of the cavity (the lower horizontal inner surface of wall 47 in FIG. 3) away from the guide members and switch and is trapped there until the switch button is pushed. When this happens, the outer guide member portion 44 of the switch button is pushed into the cavity and this urges any significant accumulation of water out of the cavity.

The above descriptions and drawings are given to illustrate and provide examples of various aspects of the invention in various embodiments. It is not intended to limit the invention only to these examples and illustrations. Given the benefit of the above disclosure, those skilled in the art may be able to devise various modifications and alternate constructions that although differing from the examples disclosed herein nevertheless enjoy the benefits of the invention and fall within the scope of the invention, which is to be defined by the following claims. Any limitation in the claims not expressly using the word "means" is not intended to be interpreted as a "means plus function" limitation in accordance with Title 35, United States Code, Section 112, and any claim limitation expressly using the word "means" is intended to be so interpreted.

What is claimed is:

1. A worklight including a worklight head with one or more halogen lamps and a power cord for energizing said one or more halogen lamps at the nominal utility service level, said worklight head having a switch housing attached thereto and a switch mounted in said switch housing for energizing said one or more lamps, wherein the improvement comprises:

a push-action switch mounted in said switch housing; and a switch button operatively associated with said switch for actuating said switch, wherein said switch button is formed to present an engagement surface to a user for actuating said switch by pressing on said surface, and wherein said surface has characteristic dimensions in first and second perpendicular directions on said surface of at least about 0.625 inch.

2. The worklight of claim 1 wherein said switch includes a depressible plunger for actuating said switch and said switch button is mounted on said plunger, further comprising:

a guide assembly disposed about said plunger to guide said switch button in its travel as said plunger is depressed thereby reducing binding.

3. The worklight of claim 2 wherein said guide assembly comprises:

one or more pairs of first and second interengaging guide members, said first guide member being fixed with respect to said switch button and said second guide member being fixed with respect to said switch housing for guiding the travel of said switch button when said switch button is pushed.

4. The worklight of claim 3, wherein said guide assembly comprises a single said pair of first and second guide members, and said worklight further comprises:

a wall extending out from said switch housing and extending around said single pair of first and second guide members and spaced apart therefrom so as to define a cavity between said wall and said first and second guide members, said cavity having an open end for receiving and expelling moisture.

5. The worklight of claim 1 wherein said surface has characteristic dimensions in first and second perpendicular directions on said surface of at least about 0.875 inch.

6. The worklight of claim 1 wherein said surface has characteristic dimensions in first and second perpendicular directions on said surface of at least about 1.5 inch.

7. The worklight of claim 6 wherein said switch includes a depressible plunger for actuating said switch and said switch button is mounted on said plunger, further comprising:

a guide assembly disposed about said plunger to guide said switch button in its travel as said plunger is depressed.

8. The worklight of claim 7 wherein said guide assembly defines one or more guide pathways spaced apart from the longitudinal axis of said plunger by at least about one-half (0.5) inch.

9. The worklight of claim 8 wherein said guide assembly comprises:

one or more pairs of first and second interengaging guide members, said first guide member being fixed with respect to said switch button and said second guide member being fixed with respect to said switch housing, wherein said one or more guide pathways are defined by the engagement of said first and second guide members of said one or more pairs.

10. The worklight of claim 9 wherein said first and second guide members are of generally cylindrical co-axial shape and disposition.

11. The worklight of claim 10, further comprising a generally cylindrical wall generally co-axial with said first and second guide members and of larger diameter than said first and second guide members disposed so as to define a cavity between said wall and said first and second guide members, said cavity having an open end for receiving and expelling moisture.

* * * * *